US006994063B2

(12) United States Patent
Murata

(10) Patent No.: US 6,994,063 B2
(45) Date of Patent: Feb. 7, 2006

(54) VARIABLE VALVE UNIT FOR INTERNAL COMBUSTION ENGINE

(75) Inventor: Shinichi Murata, Okazaki (JP)

(73) Assignees: Mitsubishi Fuso Truck and Bus Corporation, Tokyo (JP); Mitsubishi Jidosha Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/103,513

(22) Filed: Apr. 12, 2005

(65) Prior Publication Data

US 2005/0224028 A1 Oct. 13, 2005

(30) Foreign Application Priority Data

Apr. 13, 2004 (JP) ..... 2004-117810
Apr. 13, 2004 (JP) ..... 2004-117811
Apr. 13, 2004 (JP) ..... 2004-117813

(51) Int. Cl.
*F01L 1/34* (2006.01)

(52) U.S. Cl. ..... 123/90.16; 123/90.15; 123/90.6; 123/90.39; 123/90.31

(58) Field of Classification Search ..... 123/90.16, 123/90.15, 90.6, 90.39, 90.31
See application file for complete search history.

(56) References Cited

U.S. PATENT DOCUMENTS 6,425,357 B2 * 7/2002 Shimizu et al. ..... 123/90.16

FOREIGN PATENT DOCUMENTS

JP 3245492 B2 10/2001

* cited by examiner

*Primary Examiner*—Thomas Denion
*Assistant Examiner*—Zelalem Eshete
(74) *Attorney, Agent, or Firm*—Birch, Stewart, Kolasch, Birch, LLP

(57) ABSTRACT

The invention includes a first arm which opens and closes a valve, a second arm which is driven by a cam, a third arm which drives the first arm upon receiving a displacement of the second arm, and a variable mechanism which varies a supporting point of the second arm. The second arm includes a driving surface. The third arm includes an axis member in which a driven surface coming into surface contact with the driving surface is formed. The displacement of the second arm is transferred to the third arm with slippage occurring between the driven surface and the driving surface.

8 Claims, 6 Drawing Sheets

VARIABLE VALVE UNIT FOR INTERNAL COMBUSTION ENGINE

CROSS-REFERENCE TO RELATED APPLICATIONS

This application is based upon and claims the benefit of priority from prior Japanese Patent Applications No. 2004-117810, filed Apr. 13, 2004; No. 2004-117811, filed Apr. 13, 2004; and No. 2004-117813, filed Apr. 13, 2004, the entire contents of all of which are incorporated herein by reference.

BACKGROUND OF THE INVENTION

1. Field of the Invention

The invention relates to a variable valve unit for an internal combustion engine which variable valve makes the driving phase of an intake or exhaust valve to be variable.

2. Description of the Related Art

For the purposes of, for example, improving engine exhaust gas countermeasures and reducing fuel consumption, there are cases a variable valve unit is mounted in an engine as an internal combustion engine mounted in a vehicle. The variable valve unit varies the phases of intake and exhaust valves, namely, the valve-opening/closing timing of the intake and exhaust valves corresponding to the operation mode of a vehicle.

As a structure of a variable valve unit of the above-described type, a reciprocating-cam type structure is known. The reciprocating-cam type structure is a structure in which the phase of a cam formed to a camshaft is displaced by a reciprocating cam in which a base circle interval and a lift interval are connected.

A large number of reciprocating-cam type structures of the above-described type employ a rocker arm mechanism that makes the ratio between the base circle interval and the lift interval transferred to the reciprocating cam to be variable. The rocker arm mechanism causes the ratio to be variable corresponding to the operation mode of a vehicle. A variable valve unit of the above-described type is disclosed in Japanese Patent No. 3245492, for example.

In addition, for engines, pumping loss is required to improve fuel to attain fuel consumption reduction.

When the pumping loss is taken into account, when making the intake valve to be variable, the phase, namely, valve-opening/closing timing of the intake valve is preferably made variable while the closing time of the intake valve is substantially maintained. Thereby, intake air is drawn into a cylinder.

However, according to the variable valve unit disclosed in Japanese Patent No. 3245492, the cam phase of the camshaft is simply transferred to the reciprocating cam. Accordingly, a portion corresponding to a maximum lift amount of the cam phase made variable is substantially coordinated with the state of cam phase before being made variable. Then, the valve-opening time and the valve-closing time of the cam phase made variable vary with respect to the state before being made variable.

An engine in which such a reciprocating-cam type variable valve unit as described above, therefore, concurrently uses a variable valve unit of a type different from the reciprocating-cam type variable valve unit, in combination therewith.

More specifically, the engine concurrently uses a variable valve unit that uses hydraulic forces to displace the cam itself along, for example, an advancing angular direction or a retarding angular direction. The variable valve unit makes the intake valve phase to be variable so that the valve-opening time is substantially maintained constant, thereby to reduce the pumping loss.

However, the plurality of variable valve units are used as described above, the both variable valve units should be properly controlled at the same time. In addition, also a phase variability amount should be large, so that an undesirable case can perhaps occur in which the response characteristics, variability amount, and the like become insufficient, thereby causing fuel economy to remain unimproved.

BRIEF SUMMARY OF THE INVENTION

An object of the invention is to provide, by a comparatively simple configuration, a variable valve unit for an internal combustion engine which variable valve unit is capable of adjusting a valve lift amount, a valve-opening duration, and the like thereby to make the valve-closing time to be variable greater than valve-opening time while at the same time securing a sufficient variability amount.

A variable valve unit for an internal combustion engine according to the invention comprises a first arm, a second arm, and a third arm.

The first arm drives any one of the intake valve and the exhaust valve. The second arm is driven and oscillated by a cam formed to a camshaft. The second arm has a drive surface. The third arm which drives the first arm upon receiving a displacement of the second arm. The third arm includes an axis member. A driven surface coming into surface contact with the driving surface is formed in the axis member. The displacement of the second arm is transferred to the third arm with slippage occurring between the driving surface and the driven surface.

According to the configuration, in a simple configuration formed by combining the first to third arms, a sufficient variability amount is secured, and concurrently, a greater variation is performed in a valve-closing time than in a valve-opening time.

In addition, the displacement of the second arm is transferred to the third arm with slippage occurring between the driving surface formed in the second arm and the driven surface formed in the third arm. Consequently, a variation in a cam phase is smoothly accomplished. Further, since the driving surface and the driven surface are brought into surface contact with each other, a large area of contact is secured. Accordingly, the driving force for the valve driving is stably transferred from the second arm to the third arm, so that an excellent variable operation is accomplished. Further, the attitude variation of the third arm is performed using the surface contact between the driving surface and the driven surface, so that the variation is made in a wide range. As such, a sufficient variability amount of the cam phase is secured.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and configure a part of the specification, illustrate embodiments of the invention, and together with the general description given above and the detailed description of the embodiments given below, serve to explain the principles of the invention.

DETAILED DESCRIPTION OF THE INVENTION

A variable valve unit according to one embodiment of the invention will be described herebelow with reference to FIGS. 1 to 9.

Figure 1:
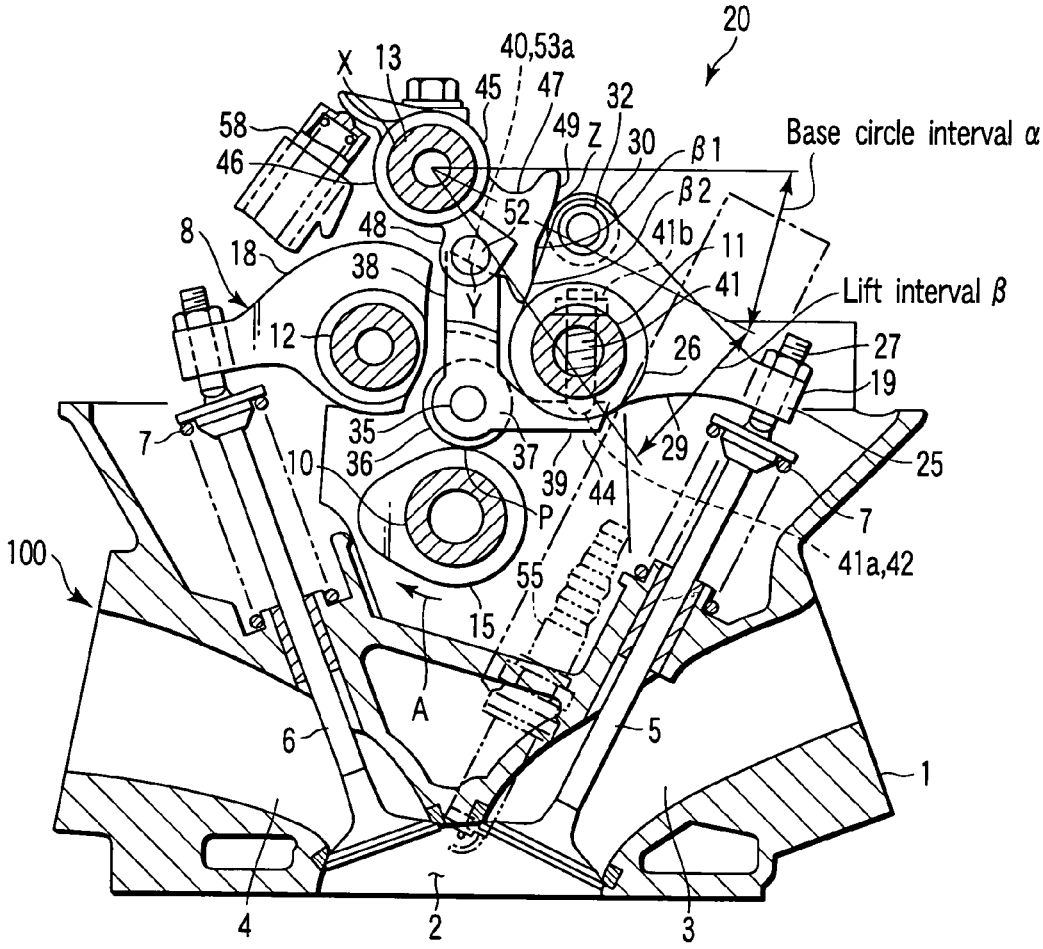
FIG. 1 is a cross sectional view showing a variable valve unit according to an embodiment of the invention together with a cylinder head in which the variable valve unit is mounted.

FIG. 1 is a cross sectional view of a cylinder head 1 of a reciprocating gasoline engine 100 shown as an example of an internal combustion engine, including a plurality of cylinders arranged straight.

In a lower portion of the cylinder head 1, a combustion chamber 2 is formed corresponding to respective cylinders. For example two intake ports 3 and two exhaust ports 4, are provided on each of two sides in units of the combustion chamber 2 of the cylinder head 1. One party of the pair of the intake port 3 and one party of the pair of exhaust port 4 are shown in FIG. 1.

In addition, intake valves 5 to open/close the intake ports 3 and exhaust valves 6 to open/close the exhaust ports 4 are attached in upper portions of the cylinder head 1. The intake valve 5 is a reciprocating valve. The exhaust valve is a reciprocating valve. Any of the plurality of intake valves 5 and any of the plurality of exhaust valves 6 is a normally closed type that is urged by a spring 7 along the closing direction.

A valve system 8 to drive the plurality of intake valves 5 and the plurality of exhaust valves 6 are provided in upper portions of the cylinder head 1. The valve system 8 is an SOHC (single overhead camshaft) type, for example.

The valve system 8 will be described here. The valve system 8 includes a camshaft 10, an intake-side rocker shaft 11, an exhaust-side rocker shaft 12, and a support shaft 13.

The camshaft 10 is rotatably disposed atop the combustion chamber 2 and along the longitudinal direction of the cylinder head 1.

The intake-side rocker shaft 11 is rotatably disposed on one side of an upper cylinder-head width direction substantially parallel to the camshaft 10. The exhaust-side rocker shaft 12 is disposed and secured substantially parallel the camshaft 10 on the opposite side of the intake-side rocker shaft 11 on the cylinder head 1.

The support shaft 13 is disposed and secured on the upper side in a portion near the rocker shaft 11, such as an upper-side portion between the rocker shaft 11 and the rocker shaft 12. Concurrently, the support shaft 13 is disposed and secured substantially parallel to the camshaft 10.

By a crank output of the engine 100, the camshaft 10 is rotationally driven in the arrow A direction shown in FIG. 1. The camshaft 10 includes a single intake cam 15 and two exhaust cams 16 that are formed in units of the combustion chamber 2.

The intake cam 15 is formed in a shaft portion of the camshaft 10. The shaft portion is a portion that opposes the center of the combustion chamber 2 in the camshaft 10. One each of the exhaust cams 16 is formed to the camshaft 10 in such a manner as to sandwich the intake cam 15.

As shown in FIG. 1, a rocker arm 18 is rotatably provided to the rocker shaft 12 in units of the exhaust cams 16, that is, in units of the exhaust valve 6. The rocker arm 18 on one side is shown in FIG. 1.

The intake-side rocker shaft 11 includes the rocker arm mechanism 19 provided in units of the intake cam 15. The rocker arm mechanism 19 drives the plurality of, namely, pair of intake valves 5 together. The rocker arm mechanism 19 opens and closes the intake valves 5 and the exhaust valves 6 in conjunction with rotation of the camshaft 10. In this case, the respective intake valve 5 and exhaust valve 6 is opened and closed in accordance with predetermined combustion cycles such as four cycles of an intake stroke, a compression stroke, a combustion-expansion stroke, and an exhaust stroke, for example.

The camshaft 10, the intake-side rocker shaft 11, and the rocker arm mechanism 19 constitute a variable valve unit 20.

Figure 2:
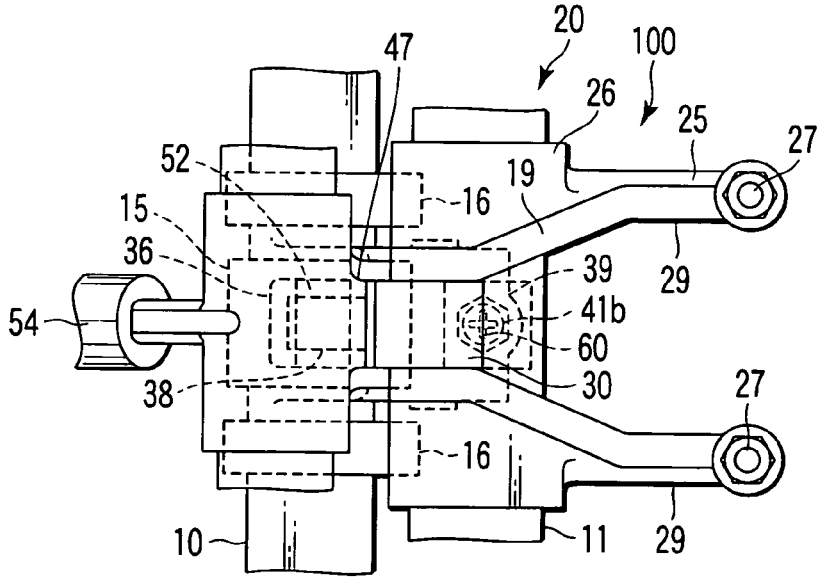
FIG. 2 is a plan view of the variable valve unit shown in FIG. 1.
Figure 3:
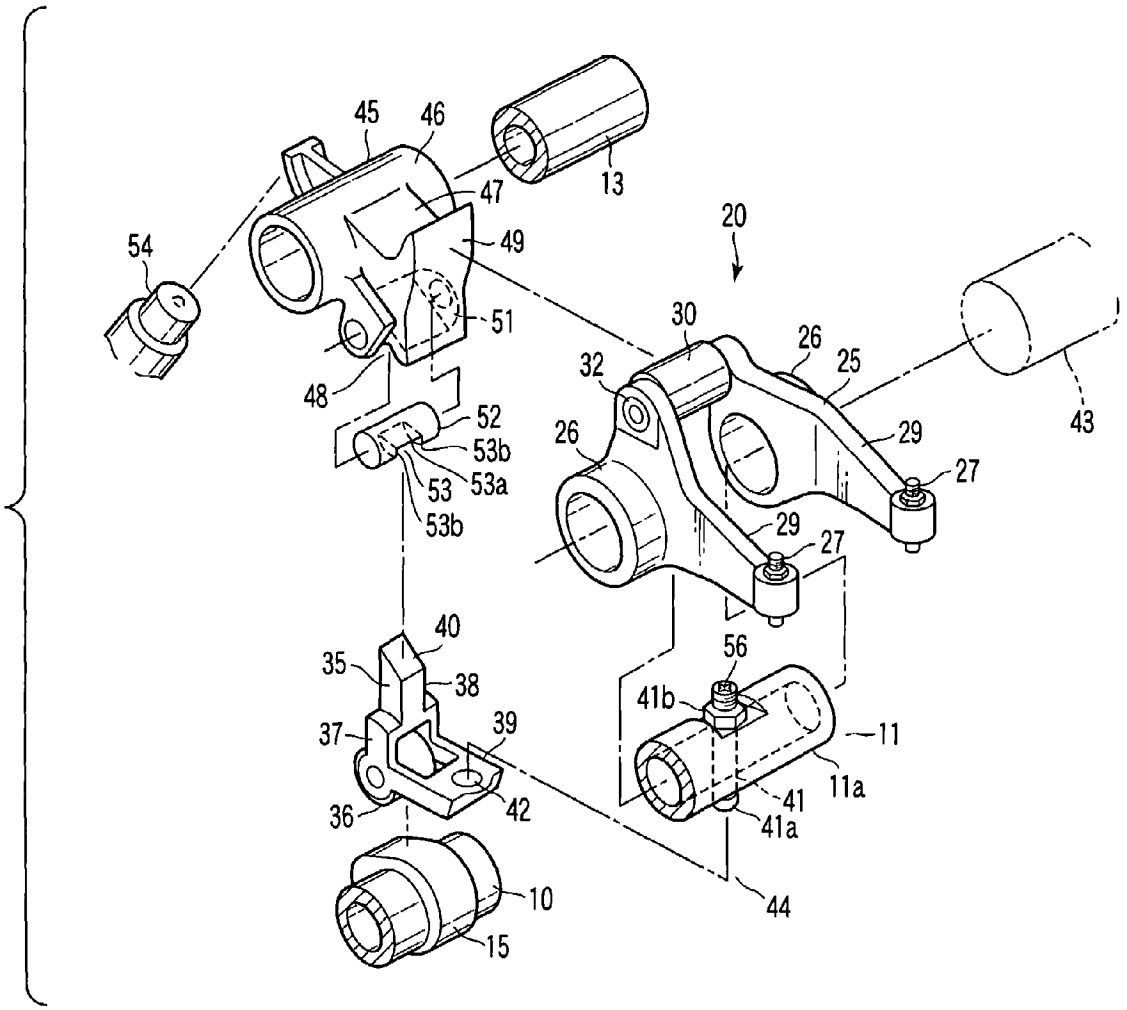
FIG. 3 is an exploded perspective view of the variable valve unit shown in FIG. 1.

FIG. 3 shows an exploded perspective view of the rocker arm mechanism 19. As shown in FIGS. 1 to 3, the rocker arm mechanism 19 includes a rocker arm 25 as a first rocker arm, a center rocker arm 35 as a second rocker arm, and a swing cam 45 as a third rocker arm.

The rocker arm 25 is oscillatably supported by the rocker shaft 11. The center rocker arm 35 is driven by the intake cam 15. The swing cam 45 is oscillatably supported by the support shaft 13.

The rocker arm 25 has, for example, a configuration in which a portion transferring displacement to the intake valves 5. The portion transferring displacement to the intake valve 5 forks into two, as shown in FIG. 3. For example, the rocker arm 25 includes a pair of rocker arm pieces 29. A cylindrical locker-shaft supporting boss 26 is provided in the center of the respective rocker arm piece 29. The respective rocker arm pieces 29 are disposed parallel to each other.

For example, an adjust screw portion 27 is provided at one end side of the respective rocker arm 25, that is, one end side of the respective rocker arm piece 29. The adjust screw portion 27 is an example of a driving portion that drives the intake valve 5. A roller member 30 is rotatably interposed between the other end portions of the rocker arm pieces 29. The roller member 30 as an abutment element is rotatably supported by a short shaft 32.

The rocker shaft 11 is passed through each respective locker-shaft supporting boss 26 of the assembled rocker arm 25 so that the rocker arm 25 is oscillatable. In this event, the roller member 30 is oriented to oppose the center side of the cylinder head 1. One of the adjust screw portions 27 is disposed at an upper end of one of the intake valves 5 extending from an upper portion of the cylinder head 1, that is, a valve stem end. The other adjust screw portion 27 is disposed at an upper end of the other intake valve 5 projecting from an upper portion of the cylinder head 1, that is, a valve stem end.

As shown in FIGS. 1 and 3, a substantially L-shaped member is used for the center rocker arm 35. The center rocker arm 35 includes a rotational engagement element such as a cam follower 36 that rotationally engages the cam surface of the intake cam 15, and a frame-shaped holder portion 37 that rotatably supports the cam follower 36.

More specifically, the center rocker arm 35 is formed in an L shape including a relaying arm portion 38 as an arm portion, and a supporting arm portion 39. The relaying arm portion 38 is extended upward from the holder portion 37, and more specifically, is extended in between the rocker shaft 11 and the support shaft 13. The supporting arm portion 39 is formed into a flat-plate shape being extended from a lateral portion of the holder portion 37 to the lower side of the rocker shaft portion 11*a*. As shown in FIGS. 3 to 7, in the rocker shaft 11, the rocker shaft portion 11*a* is a portion exposed from between the one rocker arm piece 29 and the other rocker arm piece 29.

For use as a drive surface for transferring a displacement to the swing cam 45, a sloped face 40 is formed on a leading edge of the relaying arm portion 38. The sloped face 40 has a slope formed such that, for example, the rocker shaft 11 side is lower and the support shaft 13 side is higher.

A leading edge portion of the supporting arm portion 39 is supported to the rocker shaft portion 11*a*, for example. As shown in FIGS. 1 to 3, a support mechanism for supporting the supporting arm portion 39 to the rocker shaft portion 11*a* includes, a pin member 41 and a nut 41*b*, for example.

A spherical portion 41*a* is formed in a lower end portion of the pin member 41. The pin member 41 is passed through the rocker shaft portion 11*a* to the lower side from the upper side of the rocker shaft portion 11*a*, that is, in the radial direction toward the leading edge portion of the supporting arm portion 39.

In the rocker shaft portion 11*a*, an internal thread is formed in a though-hole though which the pin member 41 is passed. An external thread for engagement with the though-hole is formed in the pin member 41. Thereby, the pin member 41 is engaged to the rocker shaft portion 11*a*. The pin member 41 secured by, for example, the nut 41*b*.

A pin end portion projecting from the rocker shaft portion 11*a* is supported by the supporting arm portion 39. A semispherical receiving portion 42 is formed on an upper surface of the leading edge portion of the supporting arm portion 39. The spherical portion 41*a* projecting from the rocker shaft portion 11*a* is rotatably engaged with the receiving portion 42.

Thereby, when the cam follower 36 is driven by the intake cam 15, the center rocker arm 35 is vertically oscillated with a supporting point set to a pivot portion where the rocker shaft 11 side, or more specifically, the spherical portion 41*a* engages the receiving portion 42.

As shown in FIG. 3, for example, a control motor 43 as a control actuator connected to the edge portion of the rocker shaft 11. The rocker shaft 11 can be desirably rotationally displaced in accordance with the operation of the control motor 43.

Figure 4:
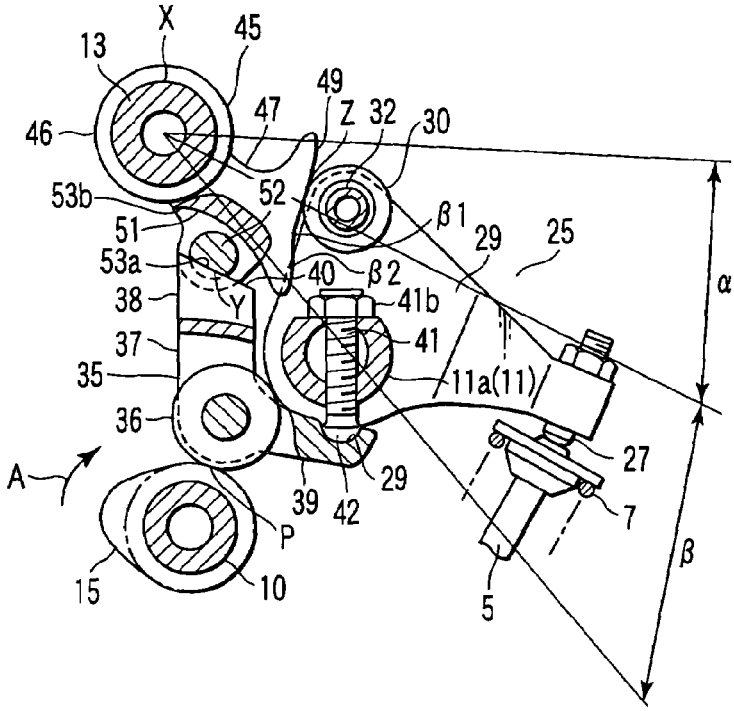
FIG. 4 is a cross sectional view showing a state where an abutment portion of a rocker arm is positioned within a base circle interval of a cam surface during maximum valve lift control of the variable valve unit shown in FIG. 1.
Figure 5:
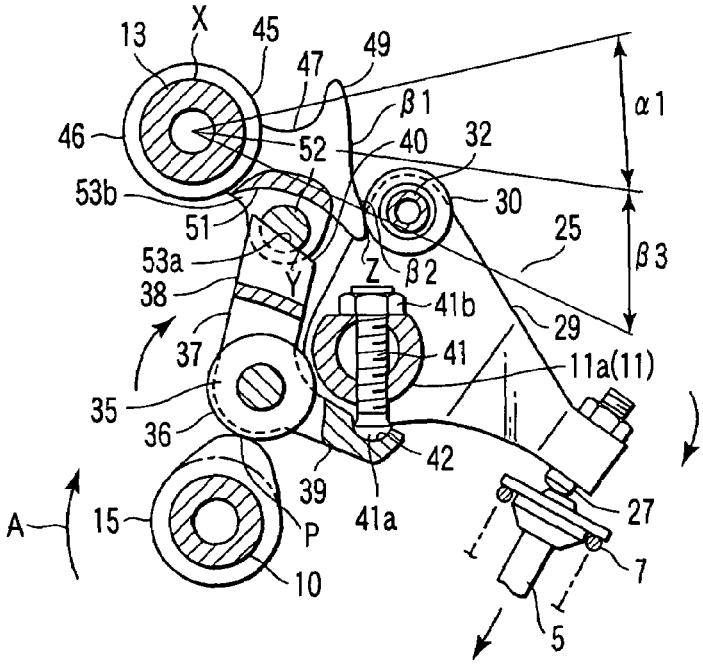
FIG. 5 is a cross sectional view showing a state where the abutment portion of the rocker arm is positioned within the lift interval of the cam surface during maximum valve lift control of the variable valve unit shown in FIG. 1.
Figure 6:
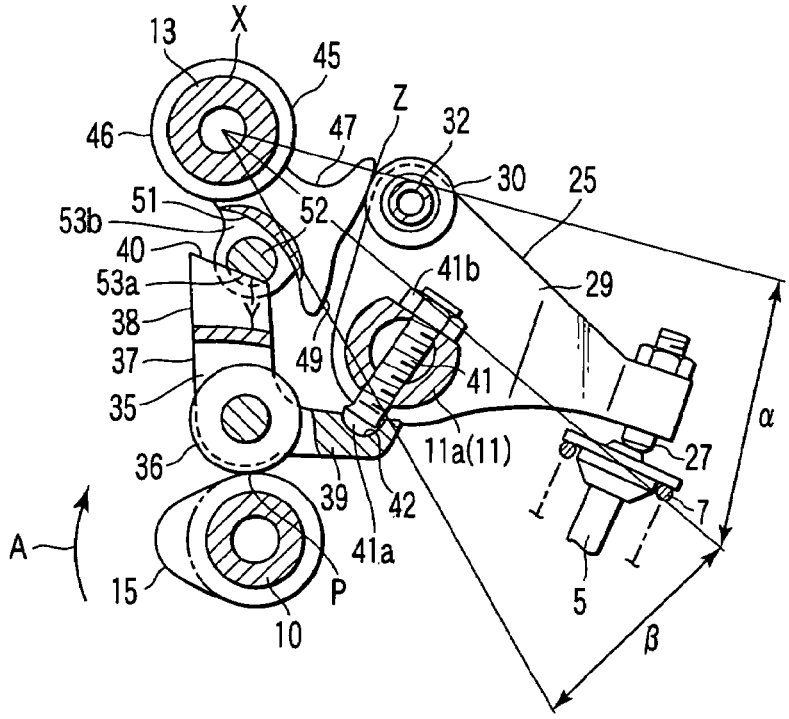
FIG. 6 is a cross sectional view showing a state where the abutment portion of the rocker arm is positioned within the base circle interval of the cam surface during minimum valve lift control of the variable valve unit shown in FIG. 1.
Figure 7:
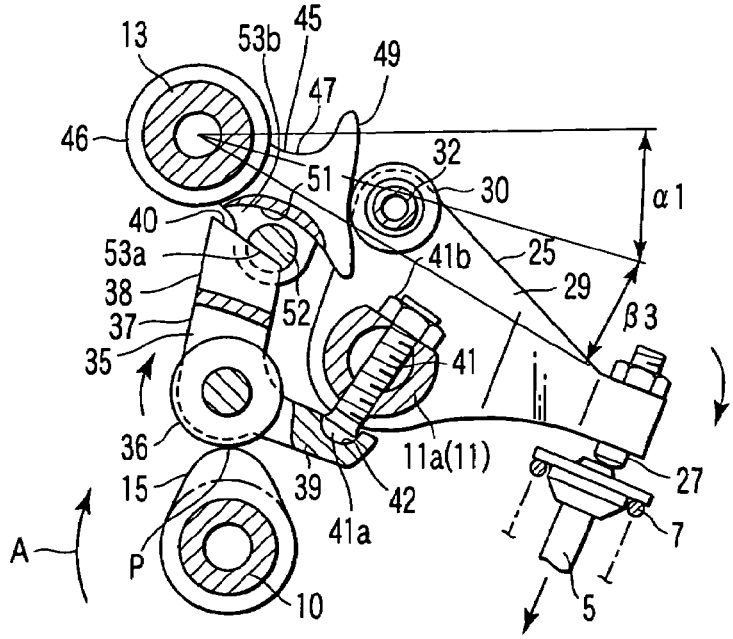
FIG. 7 is a cross sectional view showing a state where the abutment portion of the rocker arm is positioned within the lift interval of the cam surface during minimum valve lift control of the variable valve unit shown in FIG. 1.

More specifically, the rocker shaft 11 can be rotationally displaced, as shown in FIGS. 4 and 5, within the range of from, for example, an attitude in which the pin member 41 is disposed in the vertical direction to an attitude in which the pin member 41 is, as shown in FIGS. 6 and 7, tilted at an angle of 45° to the camshaft rotation direction.

As such, the control motor 43 and the pivot support structure configure a supporting-point movement mechanism the 44 as a variable mechanism. In accordance with the supporting-point movement mechanism 44, the supporting point of the center rocker arm 35 on rocker shaft 11 side can be moved along the direction of intersecting the axial direction of the rocker shaft 11, namely, the supporting point can be displaced.

As shown in FIGS. 4 to 7, the rotational engagement position P, that is, the abutment position P of the cam follower 36 with the intake cam 15 is made variable by the use of the positional shift of the center rocker arm 35 that is caused by the movement of the supporting point of the center rocker arm 35 on the rocker shaft 11 side. The rotational engagement position P of the cam follower 36 with the intake cam 15 is made variable to front and rear portions in the rotation direction of the intake cam 15.

As shown in FIGS. 1 to 3, the swing cam 45 includes a boss portion 46, an arm portion 47, and a displacement receiving portion 48. The boss portion 46 has a shape as a cylinder thorough which the support shaft 13 is passed to cause the swing cam 45 to be rotatable. The arm portion 47 extends from the boss portion 46 to the roller member 30, that is, to the rocker arm 25. The displacement receiving portion 48 is formed in a lower portion of the arm portion 47.

For being used as a transfer surface portion for transferring the displacement to the rocker arm 25, a cam surface 49 is formed on a leading edge of the arm portion 47. The cam surface 49 extends in the vertical direction, for example. The cam surface 49 is rotationally engaged with an outer peripheral surface of the roller member 30 of the rocker arm 25.

As shown in FIG. 3, the displacement receiving portion 48 includes, for example, a recess portion 51 and a short shaft 52 as an axis member, for example. The recess portion 51 is formed in a portion immediately above the camshaft 10 in the lower portion of the arm portion 47. The short shaft 52 is accommodated in the recess portion 51 to be rotatable along the same direction as that of the camshaft 10, 11. That is, the short shaft 52 is provided rotatably in the oscillation direction of the swing cam 45.

As a recess portion, a groove-shaped recess portion 53 is formed in a lower portion of the short shaft 52 exposed from an open portion of the recess portion 51. More specifically, the recess portion 53 is formed into the groove shape extending in the direction intersecting the axial center of the short shaft 52. The relaying arm portion 38, that is, the leading edge portion of the center rocker arm 35 is slidably inserted into the recess portion 53.

A receiving surface 53*a* is formed as a driven surface on a bottom wall of the recess portion 53. The receiving surface 53*a* is planar. The receiving surface 53*a* is brought into surface contact with the sloped face 40 thereby to receive the sloped face 40 to be slidable.

Thereby, upon receipt of an oscillatory displacement of the center rocker arm 35, the swing cam 45 cyclically oscillates. In this event, as shown in FIG. 1, the support shaft 13 corresponds to a supporting point X. The recess portion 53 corresponds to an action point Y at which a load from the center rocker arm 35 acts. The cam surface 49 corresponds to a power point Z at which the rocker arm 25 is driven. The supporting point X, the action point Y, and the power point Z are deployed on the same plane.

When the cam follower 36 undergoes a displacement along the direction such as advancing angular direction or retarding angular direction, namely the center rocker arm 35 is made variable to front and rear portions in the shift direction of the intake cam 15, the phase of the intake cam 15 shifts in the advancing angular direction or retarding angular direction from the attitude associated with the displacement.

A curved face variable in the distance from the center of the support shaft 13 is used for the cam surface 49. More specifically, as shown in FIG. 1, the cam surface 49 is formed into a curved face where an upper portion side is a base circle interval α and a lower portion side is a lift interval β.

The base circle interval α is formed of a circular arc plane with the axial center of the support shaft 13 in the center. The lift interval β is formed of a circular arc plane β1 opposite to and continuous with the above-described circular arc and a circular arc plane β2 continuous with the circular arc plane β1. The circular arc plane β2 is directed opposite with respect to the circular arc plane β1. The lift interval β is similar to a cam profile in a lift area of the intake cam 15, for example. The lift interval β has a function similar to the lift area of the intake cam 15.

When the cam follower 36 is displaced along the advancing angular direction, that is, when the supporting point position of the center rocker arm 35 is displaced, an area in contact with the roller member 30 varies within the cam surface 49.

More specifically, a variation takes place in the ratio between an interval α1 where the roller member 30 actually moves in the base circle interval α and an interval β3 where the roller member 30 actually moves in the lift interval β.

In accordance with the variation in the ratio between the intervals α1 and β3, the valve-opening/closing timing of the intake valve 5 is made continually variable while the valve-opening time thereof is unified. Concurrently, the valve lift amount of the intake valve 5 is made to be continually variable.

As shown in FIG. 3, as a receiving portion to receive rotational operation, for example, a cross-shaped recess portion 56 is formed on an upper end portion of the pin member 41. By the recess portion 56 of the pin member 41, the above-described engagement structure of the pin member 41, and the nut 41*b* to lock the above-described pin member 41, the valve-opening time of the intake valve 5 can be adjusted in units of the cylinder.

Figure 9:
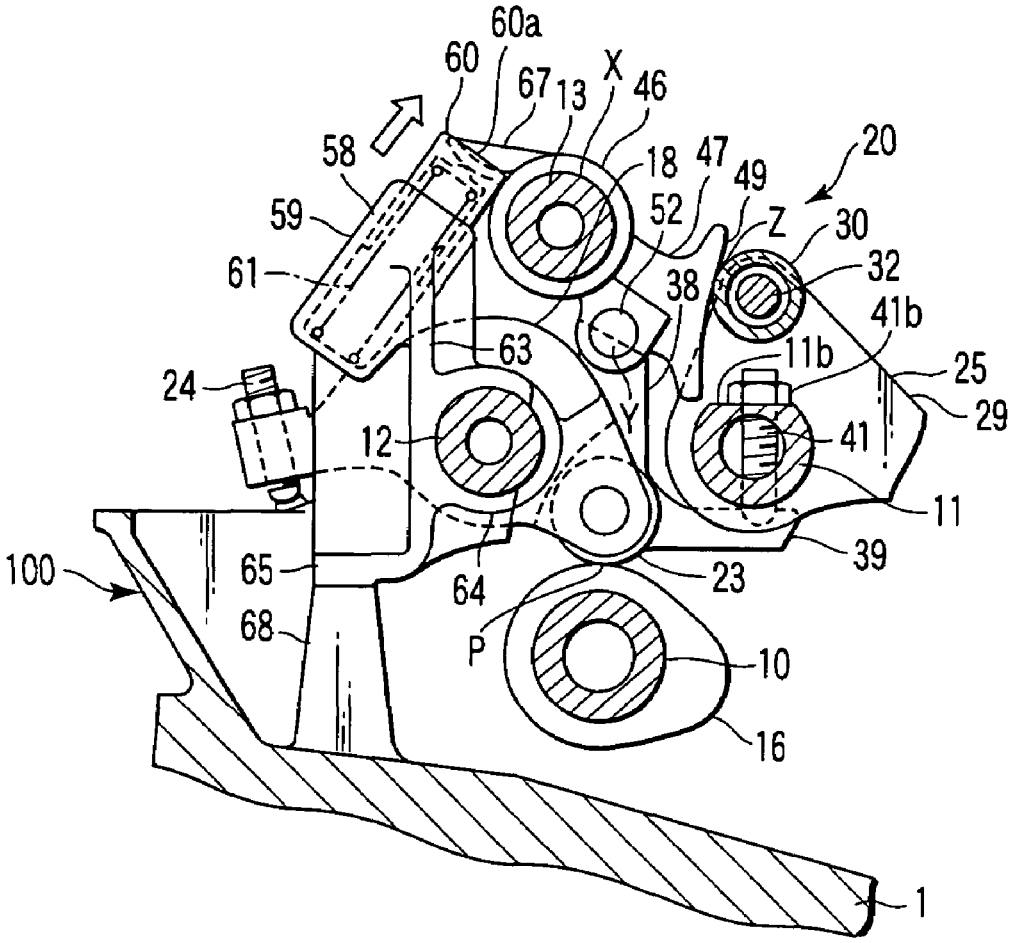
FIG. 9 is a cross sectional view of the cylinder head shown in a state where a pusher is mounted.

As shown in FIGS. 1, 3, and 9, the variable valve unit 20 includes a pusher 58. The pusher 58 has the function of urging the respective arms of the rocker arm mechanism 19 in the direction of being in intimate contact with each other. More specifically, the function urges the intake cam 15, the center rocker arm 35, and the swing cam 45 in the direction of being in intimate contact with one another.

As shown in FIG. 9, the pusher 58 includes, for example, a holder portion 59, a movable portion 60, and a coiled spring 61 as a spring member.

The holder portion 59 has a vertical, bottomed cylindrical shape with an upper end portion being open. The movable portion 60 has a bottomed cylindrical shape with a lower end portion being open. The movable portion 60 is vertically movably inserted into the holder portion 59 from the open portion of the holder portion 59. The coiled spring 61 is accommodated between an inner bottom surface of the holder portion 59 and an inner bottom surface of the movable portion 60.

The pusher 58 is mounted on the cylinder head 1 in the attitude of urging the swing cam 45 from the lower side to the upper side. The pusher 58 is mounted between a receiving portion 67 and a saddle portion 68. The receiving portion 67 is formed such as to project from the arm portion 47 of the boss portion 46 to the side opposite to the arm portion 47. The receiving portion 67 has a shape as a rib. The saddle portion 68 is formed on an upper surface portion of the cylinder head 1 on the lower side of the receiving portion 67. The receiving portion 67 is aligned with the lower portion side of the holder portion 59.

For example, a mounting leg 63 extending downward of the holder portion 59 is formed in a portion of the holder portion 59. A C-shaped insertion portion 64 in which the exhaust-side rocker shaft 12 is insertable is formed in a middle level portion of the mounting leg 63. The insertion portion 64 is formed for being used as a supporting point. A receiving seat 65 to receive counter forces is formed in a lower level portion of the mounting leg 63. The receiving seat 65 is formed by bending the leading edge portion of the mounting leg 63.

An abutment portion 60*a* formed on a leading edge surface of the movable portion 60 is abutted on an undersurface of the receiving portion 67. In addition, in the rocker shaft 12, the portion immediately below the receiving portion 67 is fitted into the insertion portion 64, and the receiving seat 65 is fitted between the receiving portion 67 and the upper surface of the cylinder head 1 in the attitude in which the receiving seat 65 is mounted on the saddle portion 68 on the lower side of the portion immediately below the receiving portion 67 in the rocker shaft 12. That is, the pusher 58 is disposed on the lower side of the swing cam 45.

For mounting the pusher 58 in a portion other than the rocker shaft 12, the pusher 58 is mounted with a tilt toward the rocker shaft 12 side. In accordance with setting of each portions 64, such as the pusher 58 itself, insertion portion, receiving seat 65, and the saddle portion 68, when the pusher 58 is mounted between the receiving portion 67 and the saddle portion 68, the movable portion 60 is pushed in to the holder portion 59.

According to the above, the coiled spring 61 is compressively deformed, thereby to cause the pusher 58 to urge the receiving portion 67.

As described above, since the swing cam 45 is urged from the lower side to the upper side by the coil spring 61, each arm is at all times brought into intimate contact not to be away from each other. This prevents lost motion.

By the above-described structural arrangement, as shown in FIG. 1, the pusher 58 is disposed on the exhaust valve 6 side with the support shaft 13 being interposed. The rocker arm 25, the center rocker arm 35, and the swing cam 45 are densely disposed on the opposite side of the exhaust valve 6 with the support shaft 13 being interposed. A free spacing exists on the exhaust valve 6 side with the support shaft 13 being interposed. Further, the pusher 58 is disposed together with the supporting point X, the action point Y, and the power point Z within the substantially same plane.

According to the above-described arrangement, free spacing defined between the rocker arms 18 or the spacing defined between the exhaust valves 6, whereby urging forces are reasonably exerted on the rocker arm mechanism 19.

As shown in FIG. 1, a spark plug 55 is provided in the cylinder head 1. The spark plug 55 ignites the fuel mixture in the combustion chamber 2.

Operation of the variable valve unit 20 configured as described above will now be described herebelow.

Firstly, the movement of the rocker arm mechanism 19 in association of the opening/closing of the intake valve 5 will be described. As shown in FIG. 1, the camshaft 10 rotates in the arrow A direction.

The cam follower 36 of the center rocker arm 35 is positioned in contact with the intake cam 15 disposed between the one rocker arm piece 29 and the other rocker arm piece 29. The cam follower 36 is then driven along the cam profile of the intake cam 15.

Then, the center rocker arm 35 is oscillated in the vertical direction with the pivot portion on the rocker shaft 11 side being as a supporting point. A displacement by the oscillation is transferred to the swing cam 45 located immediately above the center rocker arm 35.

The one end portion of the swing cam 45 is oscillatably supported by the support shaft 13. The other end portion of the swing cam 45 is in rotational engagement with the roller member 30 of the rocker arm 25. The receiving surface 53*a* formed to the rotatable short shaft 52 is in contact with the sloped face 40 formed on the front end of the relaying arm portion 38.

Thereby, the swing cam 45 iterates such motions of being lifted by the sloped face 40 and being depressed while sliding on the sloped face 40.

During the operation, slippage occurs between the sloped face 40 and the receiving surface 53*a*, and in addition to the slippage, the short shaft 52 is rotationally displaced, so that displacement of the center rocker arm 35 is smoothly transferred to the swing cam 45. The cam surface 49 is driven in the vertical direction by the oscillation of the swing cam 45 generated by the transfer described above.

The cam surface 49 is in rotational engagement with the roller member 30. The roller member 30 is, accordingly, cyclically dispersed by the cam surface 49. Upon reception of the depression, the rocker arm 25 is driven, that is, oscillated with the rocker shaft 11 as a supporting point. Accordingly, the plurality of, that is, pair of intake valves 5 are opened and closed at the same time.

During the operation described above, by rotating the rocker shaft 11, the supporting point position of the center rocker arm 35 is positioned at a point that, for example, allows a maximum valve lift amount to be secured. The rocker shaft 11 is rotated by the control motor 43.

As a consequence, the cam follower 36 of the center rocker arm 35 is displaced over the cam surface of the intake cam 15. Then, as shown in FIGS. 4 and 5, in the state where the roller member 30 is in rotational engagement with the base circle interval $\alpha$, the swing cam 45 is positioned to have an attitude in which the cam surface 49 is positioned at an angle close to the vertical.

In this manner, the attitude of the cam surface 49 is set to maximize the valve lift amount. That is, the area where the roller member 30 moves on the cam surface 49 is set to maximize the valve lift amount.

More specifically, as shown in FIG. 5, in the base circle interval $\alpha$, an interval $\alpha$1 where the roller member 30 actually moves is set shortest. Concurrently, in the lift interval $\beta$, the interval $\beta$3 where the roller member 30 actually moves is set longest.

As a consequence, the intake valve 5 is opened and closed by the rocker arm 25 driven by a cam surface portion formed of the interval $\alpha$1 and interval $\beta$3 where the roller member 30 actually moves. In this case, the valve lift amount of the intake valve 5 is maximized, as shown in a graph A1 of FIG. 8. The intake valve 5 is thus opened and closed with a desired valve-opening/closing timing.

On the other hand, when making the phase of the intake cam 15 to be variable, the rocker shaft 11 is rotated by the control motor 43. FIGS. 6 and 7 each show a state where the valve lift amount of the intake valve 5 is minimum. More specifically, as shown in FIGS. 4 and 5, the rocker shaft 11 is rotated clockwise from a position where the maximum valve lift amount is secured to a position where the valve lift amount of the intake valve 5 is minimum shown in FIGS. 6 and 7, for example. Thereby, the pivot portion, that is, the supporting point position of the center rocker arm 35 shifts to the camshaft 10 side.

The sloped face 40 of the relaying arm portion 38 and the receiving surface 53*a* of the short shaft 52 are in surface contact with each other. The portion coming into contact with the intake cam 15 of the center rocker arm 35 is formed at the cam follower 36 that rotationally engages the intake cam 15.

Accordingly, when the shift is transferred to the center rocker arm 35, the rotational engagement position P for rotationally engaging the intake cam 15 in the cam follower 36 shifts to the advancing angular direction of the intake cam 15. According to the variation of the rotational engagement position P, the valve-opening time of the cam phase being made variable is advanced corresponding to the variability amount of the pivot portion, that is, the supporting point position.

In addition, in accordance with the movement of the supporting point position, the sloped face 40 displaces, that is, slides the receiving surface 53*a* from an original position to the advancing angular direction. Thereby, as shown in FIGS. 6 and 7, the attitude of the center rocker arm 35 varies to an attitude in which the cam surface 49 of the swing cam 45 tilts to the lower side.

As the tilt of the cam surface 49 increases, the interval $\alpha$1 in which the roller member 30 actually moves in the base circle interval $\alpha$ gradually increases. The interval $\beta$3 in which the roller member 30 actually moves in the lift interval $\beta$ gradually decreases. Then, the cam profiles of the cam surface 49 made variable are transferred to the roller member 30.

Figure 8:
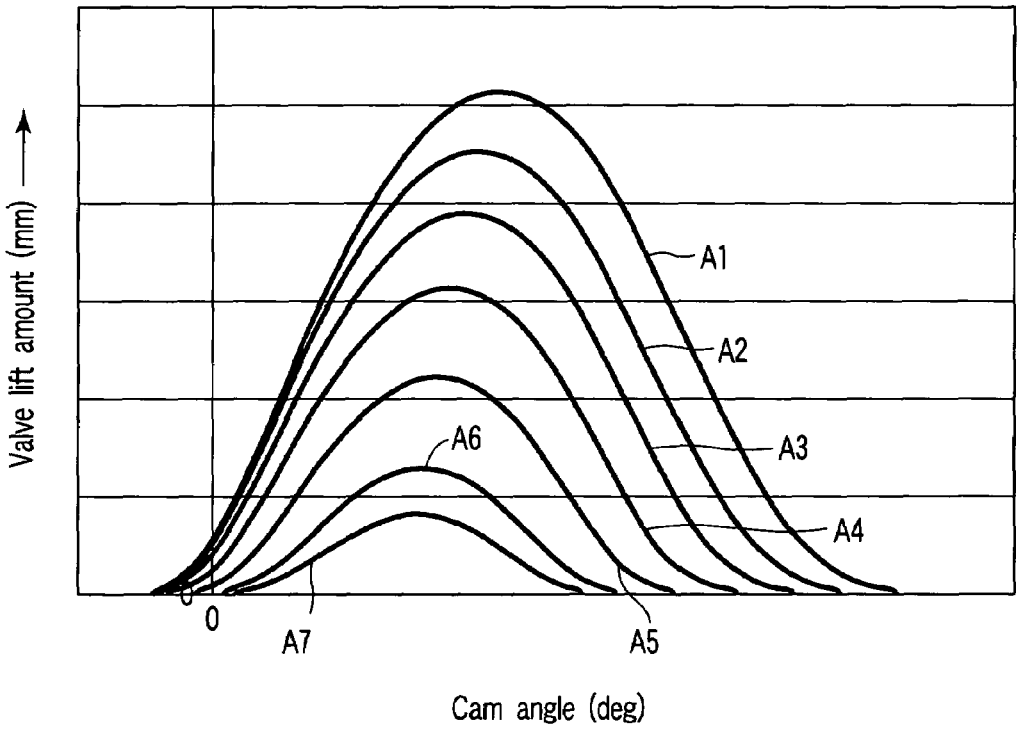
FIG. 8 is a graph showing the performance of the variable valve unit shown in FIG. 1.

Thereby, even when in accordance with the movement of the supporting point position of the center rocker arm 35, the setting of the variable valve unit 20 is varied between the state where the valve lift amount of the intake valve 5 is maximum, that is, a state A1 shown in FIG. 8, and the state where the valve lift amount of the intake valve 5 is minimum, that is, a state A7 shown in FIG. 8, the valve-opening timings of the intake valve 5 in each state become substantially the same. Concurrently, the closing timing is continuously controlled to be variable.

A each state A2 to A6 shown in FIG. 8 shows a state between the state A1 and the state A7.

As described above, the cam phase with which the valve-opening time is unified is made variable only by the rocker arm mechanism 19 formed by combining the rocker arm 25, the center rocker arm 35, and the swing cam 45.

In addition, the action point Y is provided between the supporting point X and the power point Z. Accordingly, the load acting on the supporting point X of the swing cam 45 is only a load remaining not offset among the loads from the center rocker arm 35 which acts on the action point Y and the load from the rocker arm 25 which act on the power point Z from the direction opposed to the acting direction of the loads.

Accordingly, the swing cam 45 operates in the state where the load acting on the supporting point X is restrained to be low. That is, the load burden being imposed on the swing cam 45 is light. For this reason, the variation in the cam phase is performed in the state where friction is restrained.

Accordingly, the pumping loss is reduced only by using the one system, that is, the single rocker arm mechanism 19. In addition, friction in the case of the variation in the cam phase is reduced. Further, since the load burden being imposed on the swing cam 45 is restrained, high durability is not required for the swing cam 45. Accordingly, since supporting stiffness, strength, and the like of the swing cam 45 can be reduced, the weight of the rocker arm mechanism 19 can be reduced.

In addition, in the case of transfer of the displacement of the center rocker arm 35 to the swing cam 45, slippage occurs between the sloped face 40 and the receiving surface 53*a*. Further, the short shaft 52 undergoes rotationally displacement in conjunction with the slippage. Consequently, the driving force for making the cam phase to be variable is smoothly transferred.

Further, since the sloped face 40 and the receiving surface 53*a* are brought into surface contact with each other, the surfaces contact each other in a large area. Accordingly, the driving force and displacement necessary for the valve driving is stably transferred from the center rocker arm 35 to the swing cam 45. Consequently, the variable operation is satisfactorily performed at all times.

Further, the attitude variation of the swing cam 45 is performed using the surface contact between the sloped face 40 and the receiving surface 53*a*, the variation is made in a wide range. As such, a sufficient variability amount of the cam phase can be secured. Consequently, the variable valve unit 20 can obtain sufficient variability performance.

Further, the sloped face 40 and the receiving surface 53*a* are brought into surface contact with each other in the manner that the end of the relaying arm portion 38 is inserted into the recess portion 53 of the short shaft 52 and the sloped force 40 is brought into the receiving surface 53*a*.

Accordingly, the attitude of the center rocker arm 35 is regulated by inner walls 53*b* (and 53*b*) on both sides of the recess portion 53. Accordingly, the positioning of the center rocker arm 35 is done without requiring a separate mechanism for positioning the center rocker arm 35 in the axial direction of the camshaft 10.

Particularly, the swing cam 45 is formed by using the structure in which the distance from the support shaft 13 to the cam surface 49 is varied thereby to making the cam phase being transferred to the rocker arm 25 to be continuously variable together with the valve lift amount.

Consequently, the valve-opening/closing timing of the intake valve 5 is continuously varied greater in the valve-closing time than in the valve-opening time. Also the valve lift amount of the intake valve 5 is made continuously variable. Thus, the valve lift amount and the valve-opening/closing timing are made continuously variable by greatly varying the closing time of the intake valve 5, whereby the loss in the case of drawing the intake air into the cylinder can be restrained.

Especially, the pumping loss can be effectively reduced in the manner that the valve lift amount and the valve-opening/closing timing are made continuously variable by greatly varying the valve-closing time.

Since the pusher 58 urges the swing cam 45 from the lower side to the upper portion, the pusher 58 is disposed on the lower side of the swing cam 45. As such, the height dimension of the rocker arm mechanism 19 can be restrained. Accordingly, the variable valve unit 20 is formed compact. Consequently, the overall height of the camshaft 10 is reduced.

In addition, the pusher 58 together with the supporting point X, the action point Y, and the power point Z are disposed within substantially the same plane. Accordingly, the urging force generated by the pusher 58 is transferred from the swing cam 45 to, for example, the intake cam 15 and the center rocker arm 35 reasonably without causing arm collapse. As such, the functionality of the pusher 58 is maximally exhibited. Consequently, the variable operation of the cam phase is stabilized at all times.

Particularly, the pusher 58 is disposed in the free spacing portion in the SOHC type valve system 8. As such, the pusher 58 is situated even more compact.

In addition, the position of a pusher leading edge of the pusher 58 is determined by the swing cam 45, the exhaust-side rocker shaft 11 is fitted into the insertion portion 64, and the receiving seat 65 is abutted on the upper surface of the cylinder head 1.

For essential fixing of the pusher 58, it is sufficient to fit the insertion portion 64 on the rocker shaft 12. As such, the mounting structure of the pusher 58 is simple.

Further, a load being applied on the pusher 58 simply acts on the cylinder head 1. As such, the load does not influence the exhaust-side rocker shaft 11. Accordingly, no useless burden acts on the valve system 8.

Further, the rocker arm 25 has rocker arm portions 29. The rocker arm portions 29 are disposed parallel to each other in an axial direction of a rocker shaft 11. The rocker arm portions 29 transfer a displacement to intake valves 5. The center rocker arm 35 and the swing cam 45 are interposed between the rocker arm portions 29. A displacement of the cam is transferred to the rocker arm portions 29.

According to the configuration, the center rocker arm 35 and the swing cam 45 are interposed between the rocker arm portions 29. Consequently, the rocker arm 25, the center rocker arm 35, and the swing cam 45 move smoothly.

Further, even in a configuration where a phase variable unit is used for the invention in combination, a small amount of phase variation is sufficient. As a result, response delay does not occur but fuel consumption is improved.

The invention is not limited to the one embodiment described above. The invention may be practiced or carried out in various modified ways without departing the spirit and scope of the invention. For example, according to the one embodiment described above, the invention is adapted to the rocker arm mechanism for the intake valve. However, the invention is not limited thereto, but may be adapted to a rocker arm mechanism for an exhaust valve.

Further, according to the one embodiment, the invention is adapted to the engine including the SOHC type valve system that drives the intake valve and the exhaust valve through the one shaft. However, the invention is not limited thereto, but may be adapted to an engine including a DOHC (double overhead camshaft) type valve system that has dedicated camshafts on the respective intake side and exhaust side.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve unit for an internal combustion engine to be driven by a camshaft rotatably provided in the internal combustion engine and to thereby vary a lift amount of at least one of an intake valve and an exhaust valve, the variable drive unit comprising:

a first arm which drives any one of the intake valve or the exhaust valve;

a second arm which is driven and oscillated by a cam formed to the camshaft, the second arm including a driving surface; and a third arm which drives the first arm upon receiving a displacement of the second arm, the third arm including an axis member, wherein a driven surface coming into surface contact with the driving surface is formed in the axis member; and the displacement of the second arm is transferred to the third arm with slippage occurring between the driving surface and the driven surface.

2. The variable valve unit for an internal combustion engine according to claim 1, wherein the second arm has an arm portion extending to the driven surface, the driving surface is formed on a leading edge of the arm portion and is a sloped face tilted in an oscillation direction of the third arm, the driven surface is formed to be planar on a bottom surface of a recess portion formed in a part of an circumference portion of the axis member, the recess portion being formed in a manner that a part of the circumference portion of the axis member is recessed, and the driving surface and the driven surface are brought into surface contact with each other by insertion of an end portion of the arm portion into the recess portion.

3. The variable valve unit for an internal combustion engine according to claim 1, wherein the third arm has a transfer surface portion coming into contact with the first arm to drive the first arm, the transfer surface portion includes a conversion portion where a distance from a center of a supporting axis which oscillatably supports the third arm is varied, the valve lift amount of any one of the intake valve and the exhaust valve and a phase of the cam to be transferred to the first arm are both continuously made variable in accordance with a variation in a distance from the supporting axis to the transfer surface portion, the distance from the supporting axis to the transfer surface portion is varied in conjunction with a variation in an attitude of the second arm, and the variation in the attitude of the second arm is caused by a displacement to an abutment position coming into abutment with the cam in the second arm.

4. The variable valve unit for an internal combustion engine according to claim 1, wherein the third arm has an action point which is driven upon receiving the displacement of the second arm, and a power point which drives the first arm, the third arm is rotatably supported in the oscillation direction of the third arm, and the action point is positioned between an oscillation supporting point of the third arm and the power point.

5. The variable valve unit for an internal combustion engine according to claim 1, further comprising a spring member which urges the second arm at all times to the side of the cam through the third arm to bring the second arm into intimate contact with the cam.

6. The variable valve unit for an internal combustion engine according to claim 5, wherein the spring member is provided below the third arm and urges the third arm from a lower side to an upper side.

7. The variable valve unit for an internal combustion engine according to claim 5, wherein the first arm, the second arm, and the third arm are disposed such that each abutment portion for transferring displacements, driving forces, and the like are disposed within a same plane, and the spring member is disposed within the same plane where the abutment portions are disposed, thereby to urge the third arm.

8. The variable valve unit for an internal combustion engine according to claim 1, wherein the first arm includes a first wall portion and a second wall portion, a first wall portion and a second wall portion are disposed parallel to each other in an axial direction of a rocker shaft disposed parallel to the camshaft, the first wall portion and the second wall portion transfers a displacement to any one of a plurality of intake valves and a plurality of exhaust valves, the second arm and the third arm are interposed between the first wall portion and the second wall portion, and a displacement of the cam is transferred to the first wall portion and the second wall portion.

* * * * *